US007448938B2

(12) United States Patent
Inoguchi

(10) Patent No.: US 7,448,938 B2
(45) Date of Patent: Nov. 11, 2008

(54) METHOD FOR SUPPLYING SPECTACLE LENS

(75) Inventor: Masaaki Inoguchi, Tokyo (JP)

(73) Assignee: Hoya Corporation, Tokyo (JP)

( * ) Notice: Subject to any disclaimer, the term of this patent is extended or adjusted under 35 U.S.C. 154(b) by 187 days.

(21) Appl. No.: 10/560,970

(22) PCT Filed: Nov. 4, 2004

(86) PCT No.: PCT/JP2004/016322

§ 371 (c)(1),
(2), (4) Date: Jan. 31, 2006

(87) PCT Pub. No.: WO2005/044513

PCT Pub. Date: May 19, 2005

(65) Prior Publication Data

US 2006/0276106 A1 Dec. 7, 2006

(30) Foreign Application Priority Data

Nov. 5, 2003 (JP) ..... 2003-375496

(51) Int. Cl.
*B24B 49/00* (2006.01)
*B24B 51/00* (2006.01)
*B24B 1/00* (2006.01)

(52) U.S. Cl. ..... 451/5; 451/43; 451/54; 451/57; 451/58

(58) Field of Classification Search ..... 451/5, 451/6, 42, 43, 63, 54, 57, 58
See application file for complete search history.

(56) References Cited

U.S. PATENT DOCUMENTS 5,138,770 A * 8/1992 Matsuyama ..... 33/28
5,148,637 A 9/1992 Byron
5,228,242 A * 7/1993 Matsuyama ..... 451/8
5,450,335 A * 9/1995 Kikuchi ..... 702/168
5,790,232 A * 8/1998 Hagiwara et al. ..... 351/177
RE35,898 E * 9/1998 Shibata et al. ..... 451/5
5,803,793 A * 9/1998 Mizuno et al. ..... 451/5
5,890,949 A * 4/1999 Shibata ..... 451/5

(Continued)

FOREIGN PATENT DOCUMENTS

JP A 04-013539 1/1992

(Continued)

*Primary Examiner*—Timothy V Eley
(74) *Attorney, Agent, or Firm*—Oliff & Berridge, PLC

(57) ABSTRACT

Difference between a lens edge circumference and an edged lens circumference is controlled to be always within a prescribed range so that a spectacle lens of a properly finished circumference size can always be supplied.

A method of supplying a spectacle lens by bevel-edging an uncut spectacle lens based on specified lens edge shape data includes a lens edging step (S2) to rim machine a spectacle lens based on a lens edge shape data and a prescribed edging condition of the spectacle frame, a lens circumference measuring step (S3) to measure the circumference of the spectacle lens bevel-edged by the lens edging step, a circumference difference calculating step (S4) to calculate difference between the lens circumference obtained by the step of measuring the lens circumference and the lens edge circumference of the spectacle frame, and a correcting step (S5 to S11) to correct the circumference correction value stored for every edging condition so as to put the circumferential difference within a prescribed range.

7 Claims, 8 Drawing Sheets

U.S. PATENT DOCUMENTS

| | | | | |
|---|---|---|---|---|
| 5,926,247 | A * | 7/1999 | Kimura | 351/41 |
| 6,241,577 | B1 * | 6/2001 | Shibata | 451/5 |
| 6,409,574 | B1 * | 6/2002 | Shibata | 451/5 |
| 6,427,094 | B1 * | 7/2002 | Mizuno | 700/159 |
| 6,743,486 | B1 * | 6/2004 | Miyazawa | 427/596 |
| 6,813,536 | B1 * | 11/2004 | Gottschald | 700/160 |
| 7,086,928 | B2 * | 8/2006 | Siders et al. | 451/5 |

FOREIGN PATENT DOCUMENTS

| | | |
|---|---|---|
| JP | A 07-256547 | 6/1994 |
| JP | A 06-226590 | 8/1994 |
| JP | B2 3075870 | 8/2000 |
| JP | A 2001-062677 | 3/2001 |

* cited by examiner

EDGING CONDITION NO.1: A1 AND B1 AND C1

EDGING CONDITION NO.2: A1 AND B1 AND C2

EDGING CONDITION NO.3: A1 AND B1 AND C3

•
•

EDGING CONDITION NO.X: A2 AND B2 AND C1

•
•
•

EDGING CONDITION NO.18: A3 AND B3 AND C3

METHOD FOR SUPPLYING SPECTACLE LENS

TECHNICAL FIELD

The present invention relates to a method for supplying a spectacle lens having an appropriate circumference while controlling a finished circumference of the spectacle lens in a lens edging system conducting bevel-edging of a spectacle lens based on lens edge shape data of a spectacle frame.

BACKGROUND ART

A spectacle lens plant receives an order of spectacle lens to be bevel-edged from optician's shops using public communication lines such as the Internet. In such a case, lens edge shape data measured with a lens edge shape measuring device (frame tracer) is transmitted from an optician's shop as data relating to the specified spectacle frame. The spectacle lens plant conducts bevel-edging of the lens based on the transmitted lens edge shape data and delivers the finished lens to the optician's shop. The optician's shop puts the bevel-edged lens into the spectacle frame and supplies the finished spectacles to the wearer.

However, in such a lens supply system, since no spectacle frame exist in the plant to be a edging center, it could happen that the bevel-edged lens cannot be fitted into a spectacle frame upon delivery to an optician's shop.

Therefore, proposed is a technology in which a three-dimensional spectacle frame circumference measured in advance along the frame groove of a spectacle lens frame is compared with a measured value of a three-dimensional bevel circumference along the bevel vertex of an edged spectacle lens, and whether or not the edged spectacle lens is appropriately fitted to the spectacle lens frame is checked according to the comparison result (refer to Patent Document 1, for instance).

[Patent Document 1] Japanese Patent Application Publication No. 3075870

SUMMARY OF THE INVENTION

Problems to be Solved by the Invention

However, the technology described in the Patent Document 1 is a method to individually check whether or not the difference between the lens edge circumference of a spectacle frame and the circumference of an edged lens is within a prescribed range to determine acceptance or rejection, but does not provide any countermeasure after making such a determination. As a result, the bevel-edging is continuously conducted without paying attention to fluctuations in the size of the finished circumference so that many defective products might result.

Considering the aforementioned circumstances, the present invention aims at providing a method of supplying a spectacle lens in which a spectacle lens having a properly finished circumference can always be supplied by controlling the difference between the lens edge circumference of the spectacle frame and the edged lens circumference to be within a prescribed range.

Means for Solving the Problems

In a method of supplying a spectacle lens by bevel-edging an uncut spectacle lens based on lens edge shape data of a specified spectacle frame, one aspect of the invention comprises a lens edging step for bevel-edging the spectacle lens based on the lens edge shape data of the spectacle frame and a predetermined edging condition, a lens circumference measuring step of obtaining the difference between a lens circumference which is obtained in the lens circumference measuring step and a lens edge circumference of the spectacle frame, and a correcting step of correcting the edging condition so as to keep the circumferential difference within a prescribed range.

In the present invention, a spectacle lens is supplied by being edged so that the circumferential difference between a lens edge shape of a spectacle frame and an edged lens is always within a prescribed range by correcting a circumference correction value stored for every set of edging condition at the time of lens edging. More concretely, for instance, a difference (circumferential difference) between a three-dimensional spectacle lens edge circumference along the lens frame groove of the spectacle frame and a measured value of the three-dimensional bevel circumference along the peripheral bevel vertex of the edged spectacle lens is determined, and when the difference exceeds a prescribed range, correction is made to a circumference correction value stored for every set of edging condition so as to make the difference to be within the prescribed range. As a result, fluctuation of the circumferential difference can be avoided and the edged spectacle lens can properly be fitted to the spectacle frame. Similarly, in a case of rimless spectacle frame, fluctuation of the circumferential difference can be avoided, and the edged spectacle lens can properly be fitted to the rimless spectacle frame.

Another aspect of the invention relates to a method of supplying the spectacle lens in which the lens edge shape data includes any one of the information:

three-dimensional lens edge shape information of the specified spectacle frame;

two-dimensional lens edge shape information;

a theoretical circumference, which is the circumference obtained by tracing a frame groove of a lens edge of the spectacle frame or a template of a rimless frame;

left eye/right eye information indicating whether or not the lens edge shape data traced by a lens edge shape measuring device is for the left eye or for the right eye; and frame/pattern information indicating whether or not the traced lens shape data is for the frames whose bevel groove is measured or for a pattern obtained by measuring the template of the rimless frame or a dummy lens.

Another aspect of the invention relates to a method of supplying the spectacle lens in which the edging condition is obtained by combining each element of:

an element selected from data showing the kind of a material of the spectacle lens;

an element selected from edging mode data showing whether or not a circumference shape is obtained by bevel-edging, flat-edging, or mirror-finishing, by an edging mode; and an element selected from the data showing a magnitude of a cutting pressure when a cutting processing is applied.

Another aspect of the invention relates to a method of supplying the spectacle lens wherein in the lens edging step, the spectacle lens is bevel-edged for every edging condition by using a circumference correction value stored in a correction value memory part;

in the circumferential difference calculating step, the data of the circumferential difference thus calculated is added and stored in a circumferential difference data memory part every time for each bevel-edging; and in the correcting step, the following steps are executed such as a monitoring step of continuously monitoring whether or not the circumferential difference data stored in the circumference difference data memory part is kept within a prescribed range, a circumference correction value re-making step of re-make the circumference correction value so that the circumferential difference data is returned in the prescribed range when it is beyond the prescribed range, and a correction value updating step of updating the circumference correction value of the correction value memory part to a re-made circumference correction value when the circumference correction value is remade in the circumference correction value re-making step.

Another aspect of the invention relates to a method of supplying the spectacle lens in which the circumferential difference data based on the edging result for each lens edging part is independently monitored in the monitoring step.

Another aspect of the invention relates to a method of supplying the spectacle lens in which the circumferential difference data based on the edging result for each lens edging part is independently monitored in the monitoring step.

Another aspect of the invention relates to a method of supplying the spectacle lens in which the bevel-edging is performed by using a diamond wheel as a cutting tool, in which a grind stone powder is sintered or electrodeposited in the peripheral area of a cylindrical body.

BEST MODE FOR CARRYING OUT THE INVENTION

Hereinafter, embodiments of the present invention will be explained based on the drawings.

Figure 1:
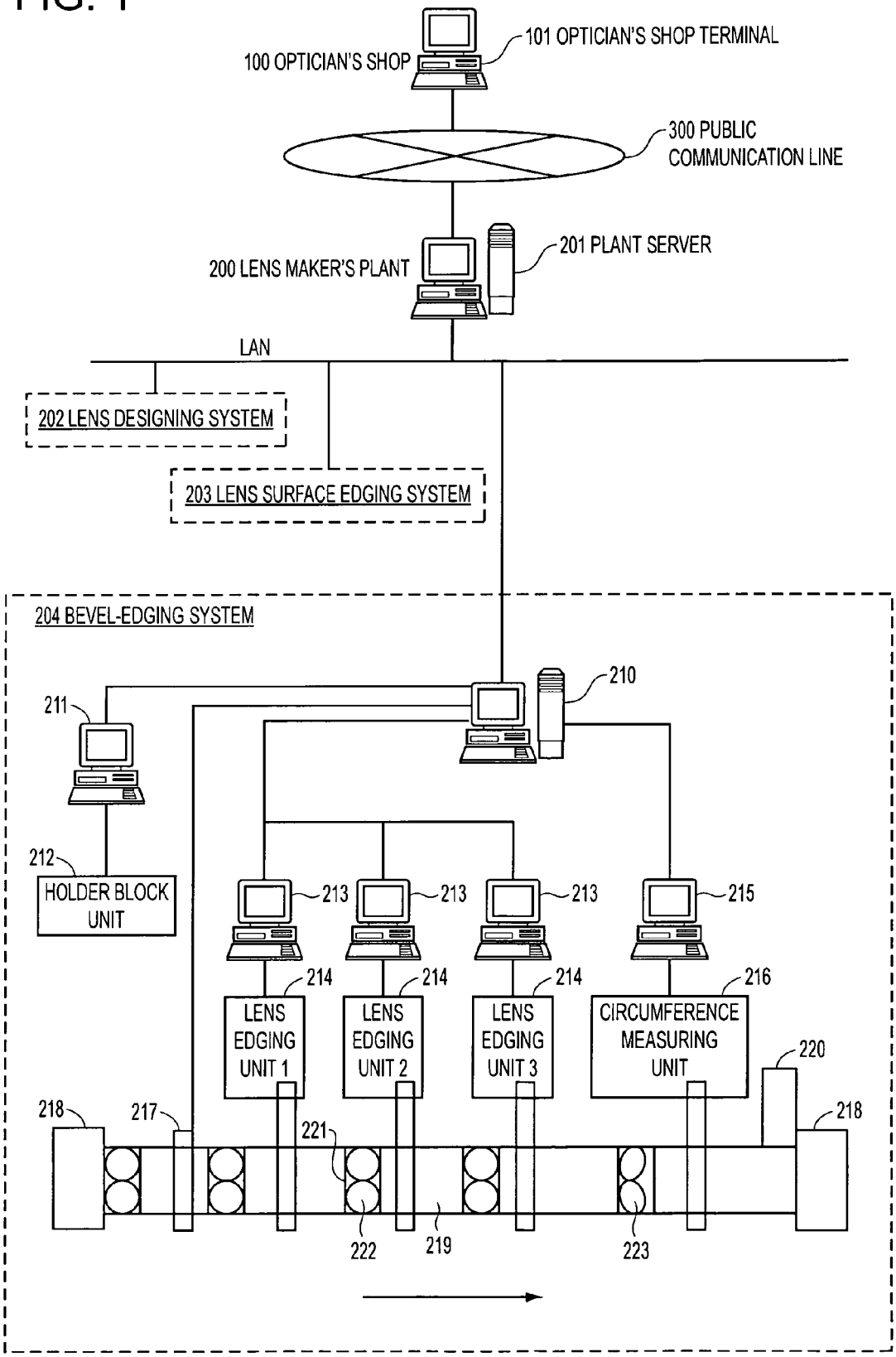
FIG. 1 is a view showing a structure of a supply system to perform a method according to an embodiment of the present invention.

FIG. 1 is a view of an entire structure of a supply system of a spectacle lens which a method of supplying the spectacle lens of the present invention is carried out.

In this system, an optician's shop 100 being an order side and a lens maker's plant 200 being a lens edging side are connected via a public communication line 300. One or a plurality of optician's shops 100 are connected to the plant 200. The connection via the public communication line 300 is established between a terminal computer 101 of the optician's shop and a plant server 201. The plant server 201 receives a lens order from an optician's terminal computer 101 and at the same time receives lens edge shape data from a lens edge shape measuring device (frame tracer, not shown) installed on the optician's shop 200 side.

On the inside of the plant 200, a network is established by connecting a lens designing system 202, a lens surface edging system 203, a bevel-edging system 204 and the like around the plant server 201 via a communication line such as a LAN.

The bevel-edging system 204 of the spectacle lens includes: a bevel-edging system server 210 which performs processing of edging information management, process management, edging history management, and issuing of control instruction; a holder block part terminal computer 211 and a holder block part 212 which install a lens holder used at the time of bevel-edging of a spectacle lens 222 on a specified position on the lens surface; at least one or more units of lens edging part terminal computers 213 and lens edging part 214 for bevel-edging based on edging data including lens data, lens edge shape data and edging condition data of the spectacle lens 222, received from the bevel-edging system server 210; a circumference measuring part terminal computer 215 and a circumference measuring part 216 for measuring and obtaining a circumference and a lens edge shape of a bevel edged spectacle lens 223 which is edged according to the lens edge shape as two-dimensional data or three-dimensional data; a carrier trays 221 for storing a pair of spectacles lens 222 and each of which a job number is given, a lens carrying part 219 which process-transfers the carrier trays 221 from charging to discharging, a stocker part 218 to store the carrier trays 221 at the time of charging and discharging, an error station 220 to error discharge a bevel-edged spectacle lens 223 of which circumference measured at the circumference measuring part 216 is out of a prescribed range, and a bar code reader 217 to distinguish the job number of the carrier tray 221.

All of the information on bevel-edging treated at the bevel-edging system 204 are controlled in a unified manner through the bevel-edging system server 210. The bevel-edging system server 210 receives job information such as lens information, lens edge shape information and the like from the plant server 201 which is in a higher level, and sends the information to the holder block part terminal computer 211, to a plurality of lens edging part terminal computers 213, and to the circumference measuring part terminal computer 215, which are in a lower level.

At the time of receiving and sending the information, edging data (lens data, lens edge shape data, edging condition data), edging date, edging part machine number, finished circumference data and the like are link controlled for a certain job number, for instance. It should be noted that though three lens edging parts 214 are connected, in the structure of the present example, it is possible to appropriately increase or decrease the number of the part in accordance with the scale of each laboratory or the number of lens edging jobs introduced.

In the present system, in order to put a finished circumference data of the spectacle lens 223 which is bevel-edged based on the lens edge shape data within a tolerable range, a circumference correction value of the lens edging part 214 is provided for every set of edging condition.

Figure 8:
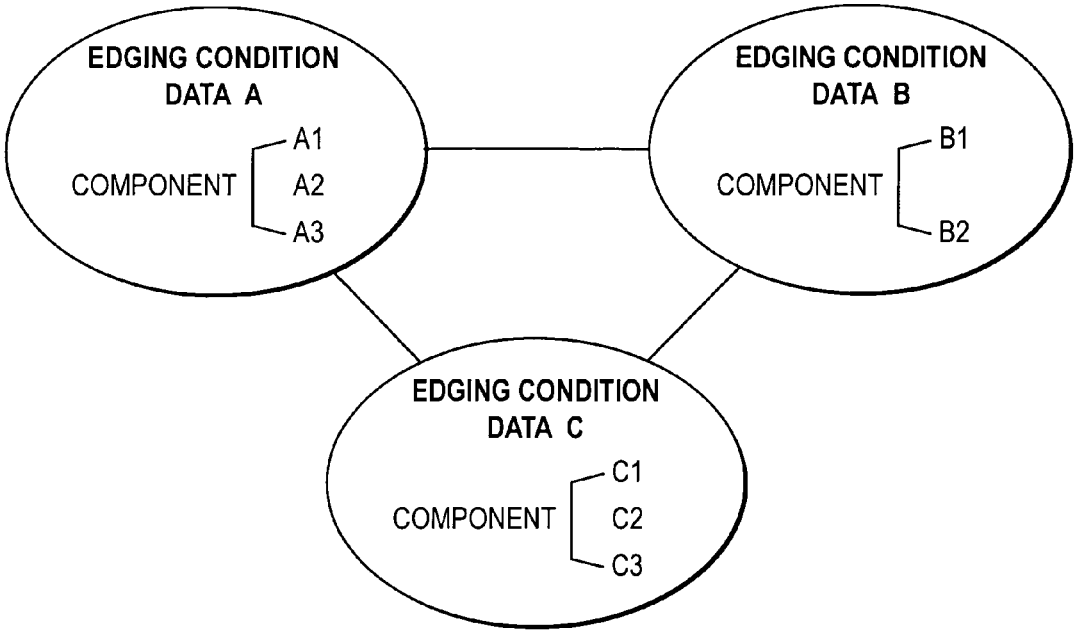
FIG. 8 is an explanatory view of edging conditions.

Incidentally, an "edging condition" indicates individual set of combination of selectable components from respective edging condition data, and is appropriately selected from respective edging condition data. FIG. 8 is an explanatory view of set of edging condition. As shown in FIG. 8, supposing that there are, for instance, three edging condition data of A (for instance, a spectacle lens material), B (for instance, an edging mode), and C (for instance, edging pressure), and when there are three selectable components A1, A2, and A3 in edging condition data A, two selectable components B1 and B2 in edging condition data B, and three selectable components C1, C2 and C3 in edging condition data C, the combination thereof is 18 kinds of edging conditions from No. 1 to No. 18, as shown in FIG. 8. Accordingly, 18 pieces of circumference correction values are required to be provided in this case.

The circumference correction value is a parameter at the time of bevel-edging and is established to remove mechanical fluctuation of plural lens edging parts 214 and size fluctuation of finished circumference depending on the edging condition. When bevel-edging is performed by using a diamond wheel as a cutting tool, in which a grind stone powder is sintered or electrodeposited in the peripheral area of a cylindrical body, the circumference correction value is established to remove the fluctuation of the circumference caused by abrasion of the diamond wheel. A specific circumference correction value is a value corresponding to an interval distance between a lens axis to be a rotation axis of the lens holder installed on the spectacle lens 222 and a holding axis of the diamond wheel which is parallel to the lens axis and serves as an edging tool, and indicates a position to be a point of reference for movement of the lens axis. Accordingly, when a circumference correction value is increased, the interval distance becomes long so that the circumference extends, and when it is decreased, the interval distance becomes short so that the circumference is shorten.

Here, the lens data included in the edging data are, for instance, a commodity code identifying the kind of lens, lens diopter, lens wall thickness, surface curve value, rear surface curve value, the kind of anti-reflection film material and lens color, and the like.

The lens edge shape data included in the edging data are data including information, for instance, the three-dimensional edge shape of a specified spectacle frame, the two-dimensional edge shape, the theoretical circumference (a circumference obtained by tracing the lens frame groove of the spectacle frame or a template for rimless frame of spectacle lenses), left eye/right eye, frame/pattern, etc. The aforementioned "left eye/right eye" indicates whether the edge shape data traced with the lens edge shape measuring device is for the left eye or right eye. The right eye side and the left eye side of spectacle frame are basically symmetrical, but their circumference may differ due to errors during manufacturing. The circumferences of the right eye and left eye may sometimes differ from each other because of a strain or the like caused by some external force. Therefore, even in the case of one set of spectacle frame, the right and left circumferences are treated as independent separate data. Fundamentally, the right eye is bevel-edged based on right eye data, and left eye is bevel-edged based on left eye data. The aforementioned frame/pattern is indicates whether the traced edge shape data are a frame or a pattern. Frame is the data obtained by measuring a bevel groove, and pattern is the data obtained by measuring a template of a rimless frame or a dummy lens.

Figure 9:
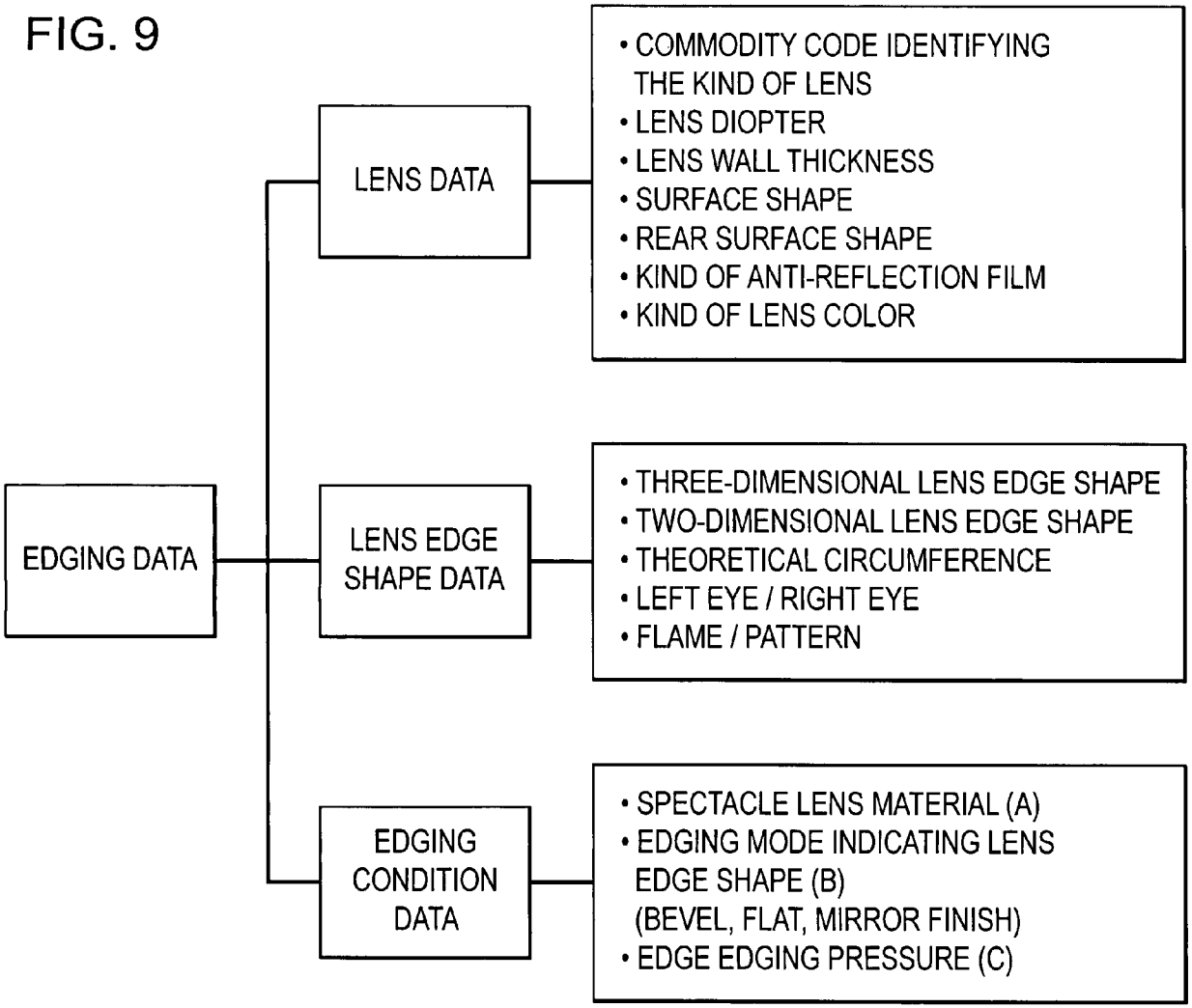
FIG. 9 is a view showing the relation between edging data, lens data, lens edge shape data and edging condition data.

The edging condition data included in the edging data are data including information, such as, when classified roughly, a kind of spectacle lens material (CR, PC, GL, and so on), an edging mode indicating an edge shape (bevel, flat, mirror-finish and the like), an edging pressure (strong, medium, weak), and the like. As a spectacle lens material, there are plastic materials such as typical CR39 (diethylene glycol diarylcarbonate), urethane based resin, PC (polycarbonate) resin, optical glass material (GL), and the like. As an edging mode indicating an edge shape, there are bevel mirror finishing, flat mirror finishing as well as an ordinary bevel and flat, and an appropriate edging mode can be selected from among these modes. The edging pressure is the pressure to press against a diamond wheel during bevel-edging of a spectacle lens based on edge shape data, and is appropriately selected depending on the lens material and lens edge thickness. FIG. 9 is a view showing the relation between the edging data, lens data, edge shape data, and edging condition data.

Next, a flowchart of the process (corresponding to a method of supplying a spectacle lens) performed in a system at the time of bevel-edging a spectacle lens based on the edge shape data of spectacle frame transmitted from an optician's shop will be explained.

The flowchart for bevel-edging process includes the following steps. Namely, the lens edging step to perform bevel-edging of a spectacle lens based on edge shape data and a prescribed edging condition of the spectacle frame, a lens circumference measuring step to measure the circumference of a spectacle lens which is bevel-edged by the lens edging step, a circumference difference calculating step to determine the difference between the lens circumference determined by the lens circumference measuring step and a lens edge circumference of the spectacle frame, and a correcting step to correct the aforementioned edging condition so as to put the aforementioned circumferential difference within a prescribed range, are included.

In this event, in the lens edging step, a bevel-edging of a spectacle lens is performed using a circumference correction value stored in a correction value memory part for every edging condition. In the circumference difference calculating step, calculated circumference difference data is additionally stored in succession in the circumference difference data memory part for every bevel-edging. In the correcting step, a monitoring step to continuously monitor whether or not the circumference difference data stored in the circumference difference data memory part is within a prescribed range, a circumference correction value preparing step to revise the circumference correction value to restore the circumference difference data to be within the prescribed range when it exceeds the prescribed range, a correction value renewing step to renew the circumference correction value in the correction value memory part to a renewed circumference correction value when a circumference correction value is revised, are conducted.

As described above, a spectacle lens is edged by correcting a circumference correction value for every edging condition at the time of lens edging, so as to put a difference between the circumference of edge of spectacle frame and the circumference of edged lens within a prescribed range. More concretely, a difference (circumferential difference) in measured value between the three-dimensional edge circumference of spectacle lens along the lens frame groove of the spectacle frame and the three-dimensional beveled circumference along the peripheral bevel vertex of the edged spectacle lens is determined, and when the difference exceeds a prescribed range, deviation from the tolerable circumference difference can be avoided by adding correction to a circumference correction value stored in the correction value memory part for every edging condition so as to make the difference to be within the prescribed range, and the edged spectacle lens can be precisely and adequately fitted or assembled to the spectacle frame.

EXAMPLE 1

Figure 2:
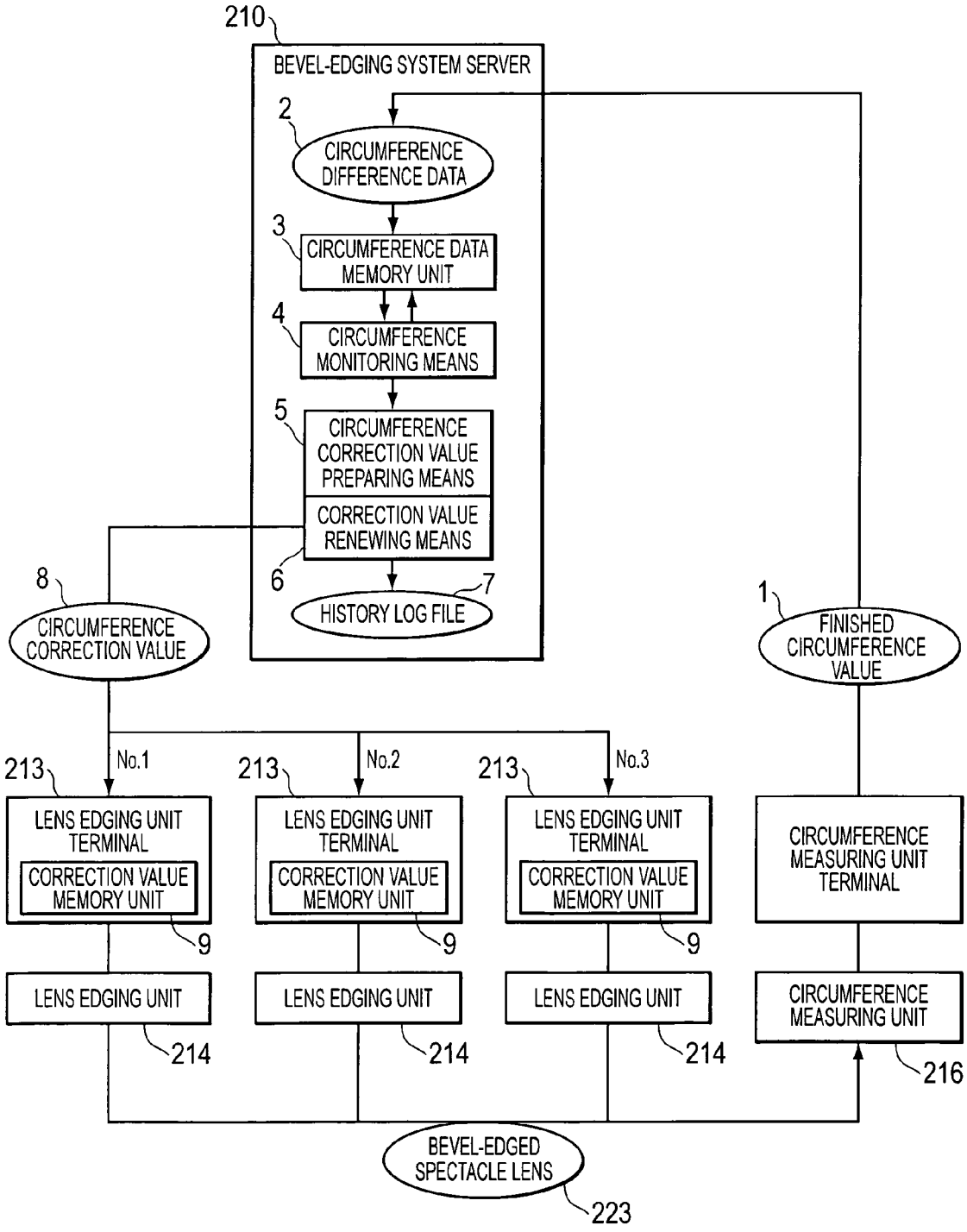
FIG. 2 is a block diagram showing a method of re-making the circumference correction value in Example 1 of the present invention.

A first example in the case of renewing a circumference correction value will be explained according to FIG. 2 as Example 1.

In this example, a bevel-edging system server 210 continuously monitors whether or not circumference difference data 2 taken from a difference between the theoretical circumference, which is a component of lens edge shape data and finished circumference data 1 is in a prescribed range. The detailed explanation will be made hereinafter.

By measuring with a circumference measuring part 216 an outer periphery of a bevel-edged spectacle lens 223, which is bevel-edged by a lens edging part 214, a circumference measuring part terminal computer 215 obtains the finished circumference data 1. The circumference measuring part 216 uses a circumference measurer, described in, for instance, Japanese Patent Application Publication No. 3208566 filed by the present applicant. The finished circumference data 1 are a circumference of a spectacle lens bevel-edged based on the lens edge shape data, or a set of the prescribed angle determined by equally dividing the entire periphery with a prescribed number and a radius, namely rθ, and the like. The data format can be appropriately selected according to the specification of the system.

The finished circumference data 1 is transmitted to the bevel-edging system server 210 where the circumference difference data 2 are determined by taking the difference between the finished circumference difference data 1 and the theoretical circumference which is a component of the lens edge shape data. The circumference difference data 2 are transmitted to circumference data memory part 3 together with a job number, edging data, (lens data, lens edge shape data, and edging condition data), a lens edging part machine number, etc. and the respective items are stored in a linked data form. The circumference data memory part 3 stores various data linked to the circumference difference data 2 by the number of bevel-edging jobs conducted heretofore, and will store data for every additional bevel-edging in succession from the current time onward.

On receiving instructions from the bevel-edging system server 210, a circumference monitoring means (corresponding to the aforementioned circumference monitoring step) 4, a circumference correction value preparing means (corresponding to the aforementioned circumference correction value preparing step) 5, and a correction value renewing means (corresponding to the aforementioned correction value renewing step) 6 are conducted as follows.

The circumference monitoring means 4 selects from at least one or more sets of the circumference difference data 2 stored in the circumference data memory part 3 data having the same conditions (for instance, a set of edging conditions and a lens edging part machine number) as the newly stored data, calculates the mean value, and continuously monitors whether or not the mean value is within a prescribed range. For instance, the mean value is calculated from the latest three data among the circumference difference data 2 having the same condition so as to continuously monitor whether or not the mean value is within ±0.15 mm (prescribed range of the circumference error).

An example case where preparation of a circumference correction value is not required in continuous monitoring of circumference difference data 2 will be described below. The result calculated from the latest three data sharing the following machine condition in which the edging mode is "bevel", the spectacle lens material is "CR", the edging pressure is "strong", and the machine number of the lens edging part is "No. 1", will be shown in Table 1.

TABLE 1

| THEORETICAL CIRCUMFERENCE | FINISHED CIRCUMFERENCE DATA | CIRCUMFERENCE DIFFERENCE DATA |
|---|---|---|
| 188.80 | 188.90 | +0.10 |
| 188.90 | 189.01 | +0.11 |
| 189.00 | 189.12 | +0.12 |

MEAN VALUE +0.11

In this case, since the mean value of the circumference difference is +0.11 mm, which is within the prescribed range of the circumference error±0.15 mm, no correction is required.

The following is an example in which preparation of a circumference correction value is required in continuous monitoring of circumference difference data 2. The result of the latest three data sharing the following set of machine condition in which the edging mode is "bevel", the spectacle lens material is "CR", the edging pressure is "strong", and the machine number of the lens edging part is "No. 1", will be shown in Table 2.

TABLE 2

| THEORETICAL CIRCUMFERENCE | FINISHED CIRCUMFERENCE DATA | CIRCUMFERENCE DIFFERENCE DATA |
|---|---|---|
| 188.80 | 188.95 | +0.15 |
| 188.90 | 189.06 | +0.16 |
| 189.00 | 189.17 | +0.17 |

MEAN VALUE +0.16

In this case, since the mean value of the circumference difference is +0.16 mm, which is outside of the prescribed range of the circumference error±0.15 mm, correction is required.

Note that all numerical values such as average number of times, prescribed range of circumference difference error and the like, serve as a parameter, and it is possible to appropriately change them according to the specification.

As a result of monitoring, when the mean value exceeds the prescribed range, the bevel-edging system server 210 transmits instruction to prepare a circumference correction value to the circumference correction value preparing means 5. The bevel-edging system server 210 is provided with the aforementioned circumference monitoring means 4 independently of, for instance, three parts of lens edging parts 214. Furthermore, the bevel-edging system server 210 has the aforementioned circumference monitoring means 4, for instance, inside one part of the lens edging part 214, independently for edging condition of a spectacle lens to be bevel-edged.

When the mean value of the circumference difference data 2 is judged to be outside of a prescribed range by the circumference monitoring means 4, the circumference correction value preparing means 5 prepares a circumference correction value 8 to restore the mean value within the prescribed range. When the mean value exceeds the prescribed range, a prescribed number K is reduced from a present circumference correction value J to prepare a renewed circumference correction value I as shown in the following equation (1). When the mean value is below the prescribed range, a prescribed number K is added to a present circumference correction value J to prepare a renewed circumference correction value I as shown in the following equation (2).

$$I=J-K \quad (1)$$

$$I=J+K \quad (2)$$

(where, I: a renewed circumference correction value

J: a present circumference correction value

K: a prescribed number)

For instance, when the present circumference correction value is "848" and the prescribed number to be increased or decreased is "8", if the mean value of the finished circumference data 1 exceeds a prescribed range, the circumference correction value is set to "840", and when it is below the prescribed range, the circumference correction value is set to "856". Though the prescribed number to be increased or decreased is "8" in the above example, its magnitude should be determined based on the design. In actual operation, it is determined after the relation between the prescribed number and the amount of change in the circumference error is found empirically. Accordingly, it is possible to adequately alter the prescribed number according to the specifications, as a parameter.

Figure 6:
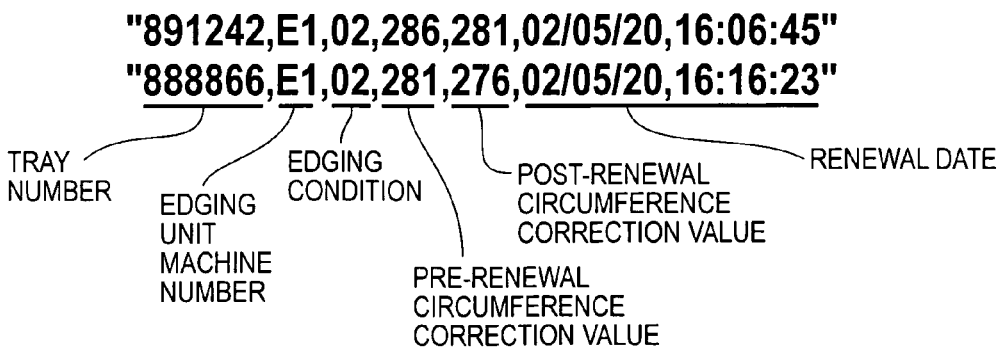
FIG. 6 is a view showing a list of the historical log file.

When a circumference correction value 8 is prepared by the circumference correction value preparing means 5, the correction value renewing means 6 determines which lens edging part 214 and which set of conditions of the circumference correction value 8 should be altered, from the circumference difference data 2 in which respective items are linked to each other, and renews by rewriting the circumference correction value 8 prepared by the circumference correction value preparing means 5 to the correction value memory part 9, without suspending movement of the bevel-edging system. The record of the renewal is stored in a history log file 7. As shown in a list of the history log file in FIG. 6, a tray number, an edging part machine number, a set of the edging conditions, values before and after renewal of the circumference correction value, renewal date, and the like are arranged for tracking.

The correction value memory part 9 is held inside the lens edging part terminal computer 213 for every lens edging part 214 and stores the circumference correction values 8 used to rim-machine a spectacle lens based on the lens edge shape data, for every edging condition. The bevel-edging system of spectacle lens usually have at least one or more sets of the lens edging parts 214. However, it is difficult for a plurality of lens edging parts 214 to remove fluctuations of mechanical accuracy, even though they are assembled with the same parts and the same process. Accordingly, the correction value memory part 9 is held for every lens edging part 214 to keep each circumference correction value 8. Since a finished circumference differs in each setting depending on the edging condition, it is preferable to keep circumference correction values 8 under the same number as the number of respective edging conditions.

The edging conditions in this case indicate, as described previously, each of combination of respective selective components included in respective edging condition data such as spectacle lens materials, edging mode indicating lens edge shape, edging pressures and the like, which are appropriately selected from the respective edging condition data. Furthermore, it is conceivable that when a spectacle lens of a new material is developed in future, the selective components for the respective edging conditions may increase accordingly, and the circumference correction values 8 can be appropriately set as required by the circumstances.

Figure 5:
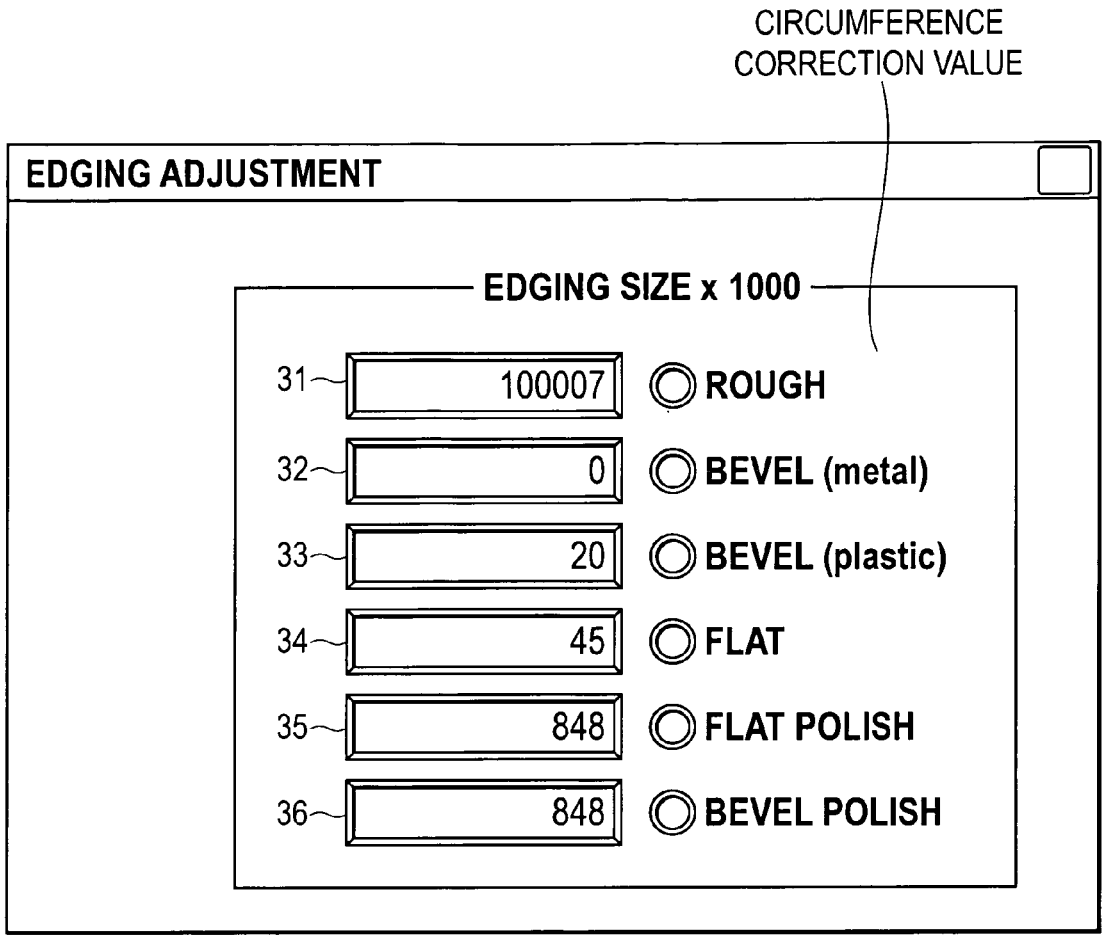
FIG. 5 is a view showing an example of an edging adjustment screen

FIG. 5 is a view showing an example of an edging adjustment screen showing the circumference correction values 8 for the aforementioned each lens edge shape. Generally, the edging adjustment screen is not displayed on a monitoring screen, but it is possible to confirm a circumference correction value 8 by displaying it on the monitoring screen by operation of an operator 22. Among the frames in the drawing, 31 denotes a circumference correction value for the rough edging size, 32 denotes the same for the bevel finish size (metal), 33 denotes the same for the bevel finish size (cell), 34 denotes the same for the flat size, 35 denotes the same for the flat mirror finish size, and 36 denotes the same for the bevel mirror finish size.

Figure 4:
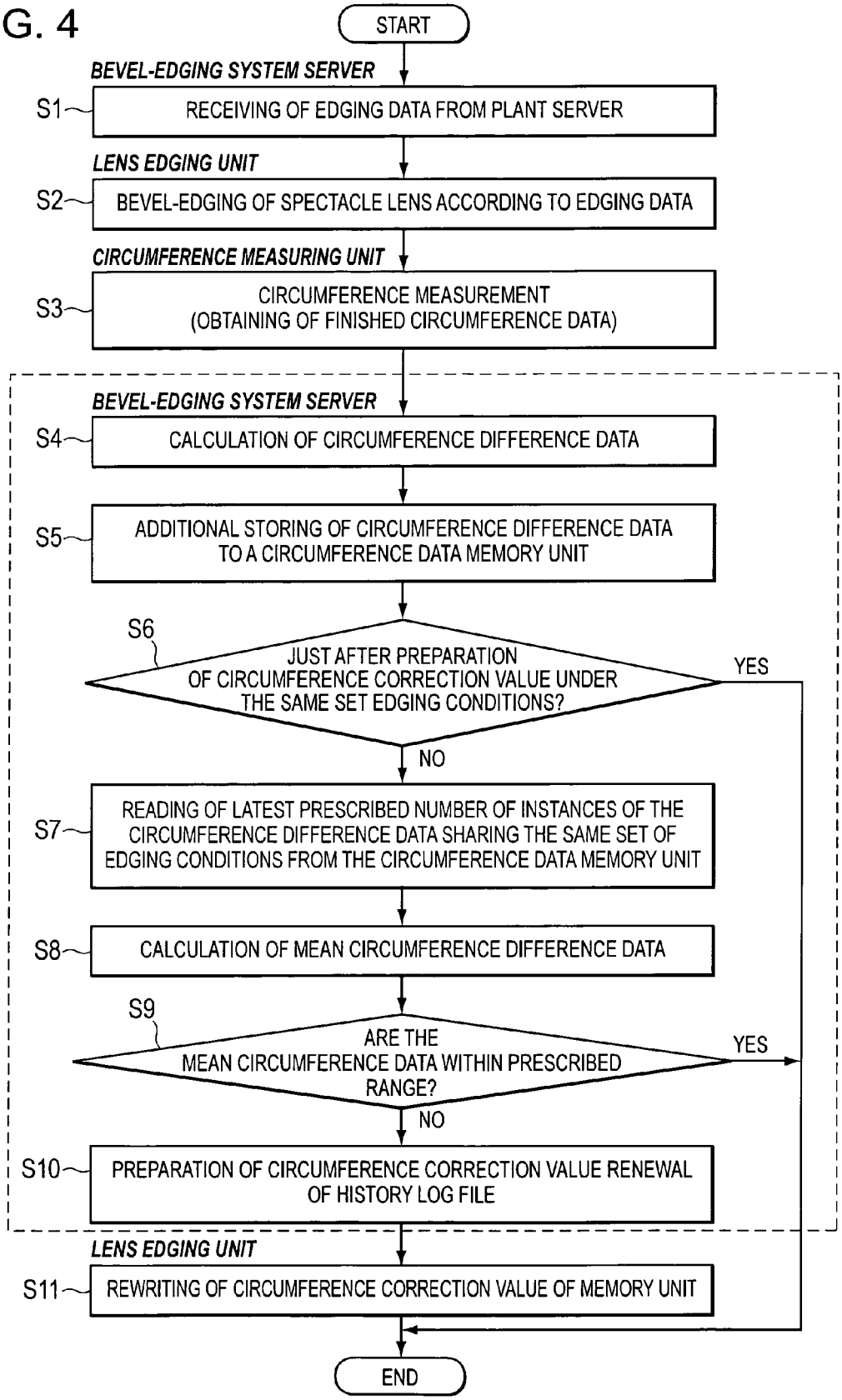
FIG. 4 is a view showing a flowchart for automatic re-make of the circumference correction value in Example 1 of the present invention.

The process of automatic renewal of a circumference correction value described above will be explained using a flowchart in FIG. 4. The contents of the processing for respective steps are as follows.

In Step S1, edging data (lens data, lens edge shape data, edging condition data) from the plant server 201 is received with the bevel-edging system server 210. In Step S2, bevel-edging of a lens 222 is conducted by the lens edging part 214 based on the edging data (lens data, lens edge shape data, edging condition data). In Step S3, finished circumference data 1 is obtained by measuring the circumference of a bevel-edged lens by the circumference measuring part 216.

Step S4 and the following Steps thereafter are processed by the bevel-edging system server 210, and in Step S4, the difference between the finished circumference data 1 and the theoretical circumference is taken to calculate the circumference difference data 2. In Step S5, the circumference difference data 2 is added to the circumference data memory part 3 and stored there. In Step S6, judgment is made whether the preparation of a circumference correction value 8 have just been prepared or not under the same set of the edging condition, and if the circumference correction value 8 is determined to have just been prepared for the same edging condition, then processing finishes. Otherwise, processing continues on Step 7.

In Step S7, the latest prescribed number of the circumference difference data 2 sharing the same edging condition (data stored this time is included as well) are read from the circumference data memory part 3. In Step S8, the mean circumference difference data is calculated. Step S9 judges whether or not the mean circumference difference data is within the prescribed range. If it is, then processing is stopped. If it exceeds the prescribed range, then processing continues on Step 10. In Step S10, the circumference correction value 8 is prepared and history log file 7 is renewed. In Step S11, the circumference correction value 8 of the correction value memory part 9 is rewritten by the lens edging part 214.

Figure 7:
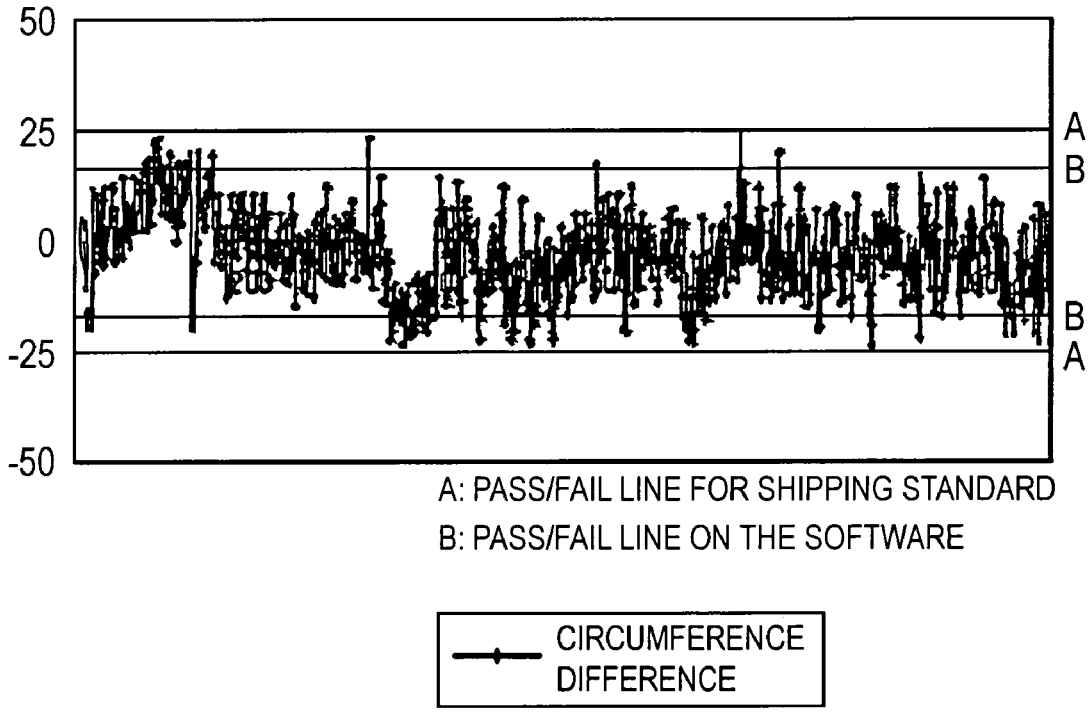
FIG. 7 is a graph showing a history of a circumference difference.

History of changes in circumference difference in the operation of the spectacle lens bevel-edging system is shown by the graph in FIG. 7. The vertical axis is a circumference difference, and the horizontal axis is its history of changes. The pass/fail lines A for a shipping standard are a permissible range for the circumference difference determined by the spectacle lens bevel-edging system, and have the same amount of width on both positive and negative sides of the circumference difference 0. The pass/fail lines B on the soft ware are another permissible range for the circumference difference appropriately determined by the circumference monitoring means, and in the case of exceeding this range, the circumference correction value is renewed. The fluctuation of the finished circumference size is stabilized by narrowing the width of pass/fail lines B on the soft ware to a value smaller than that of the pass/fail lines A for the shipping standard.

EXAMPLE 2

Figure 3:
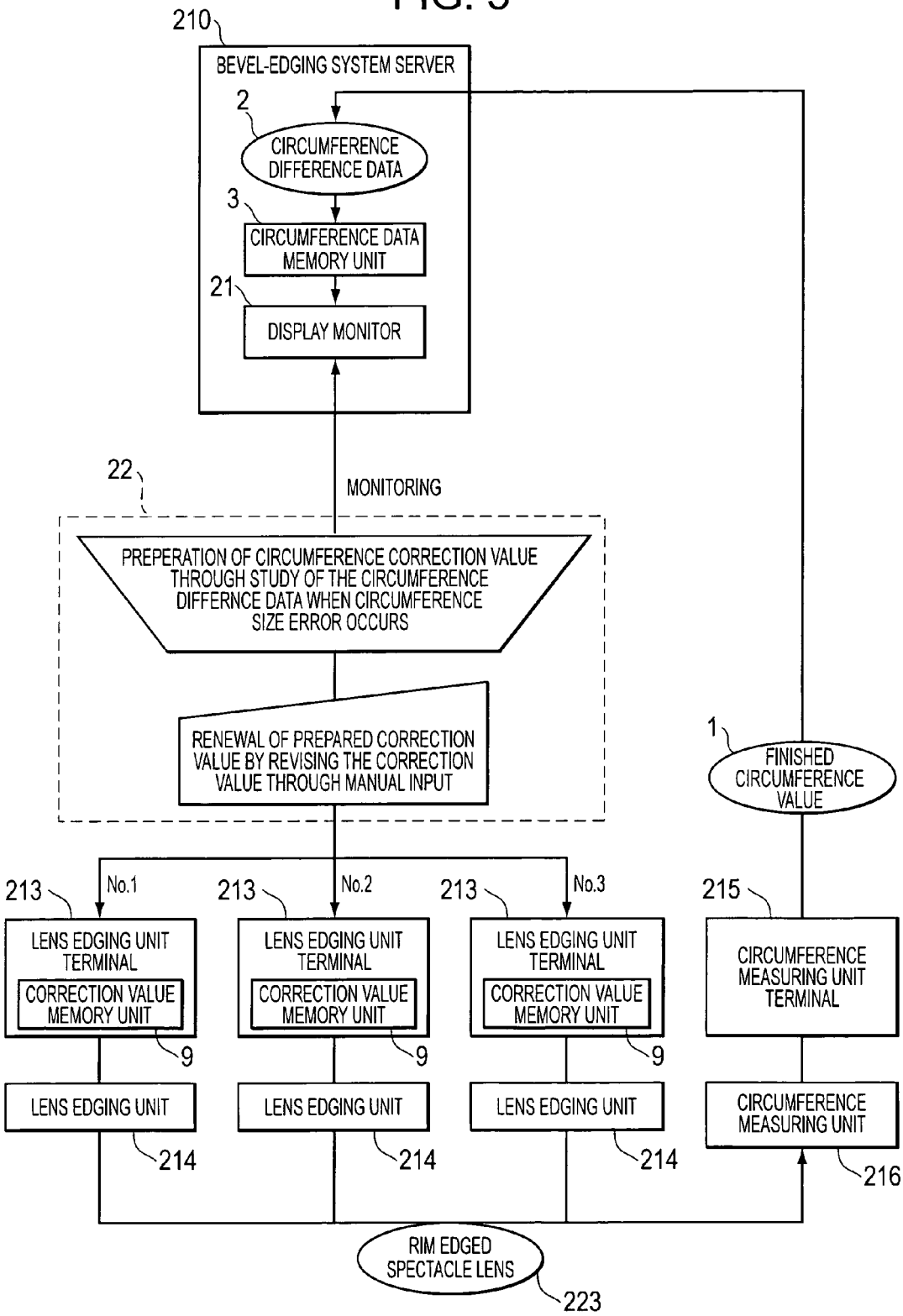
FIG. 3 is a block diagram showing a method of re-making the circumference correction value in Example 2 of the present invention.

A second example in the case of renewing a circumference correction value will be explained according to FIG. 3 as Example 2.

In this Example 2, the operator 22 himself judges whether or not a circumference difference data 2 which is a difference between the theoretical circumference and a finished circumference data 1 being one component of the lens edge shape data is within a prescribed range by continuously monitoring screen information on a display monitor 21 of the bevel-edging system server 210. On the display monitor 21, a lens edging part machine number, a set of edging conditions, a finished circumference, a difference from the theoretical circumference, pass/fail judgment result and the like are displayed for every time when edging corresponding to a job number is completed. For instance, when the pass/fail judgment result of the display monitor 21 results in "fail", and the circumference difference data 2 is outside of the prescribed range, the operator 22 calculates a circumference correction value 8 in the corresponding edging condition of the lens edging part 214, and rewrites the calculated circumference correction value 8 into the correction value memory part 9 of the lens edging part terminal computer 213 to renew. As a screen for renewal by rewriting, an edging adjustment screen in FIG. 5 is used. As described above, though it requires some manual work, it can perform the same effect as that in Example 1.

EFFECT OF THE INVENTION

According to the present invention, since it becomes possible to correct a circumference before actual circumference error occurs, occurrence of circumference error can substantially be reduced, so that an edged spectacle lens can appropriately be fitted to spectacle frame or can adequately be assembled. Especially, when bevel-edging is conducted using a diamond wheel as an edging tool, the edging results are apt to undergo influence of spectacle lens material, thickness of the spectacle lens, air temperature, etc., and the finished circumferences are apt to fluctuate, which makes it difficult to stabilize the finished circumference. However, the finished circumference can be stabilized to increase edging accuracy by adopting the present invention.

EXPLANATION OF NUMERALS AND SYMBOLS

100 OPTICIAN'S SHOP
101 OPTICIAN'S SHOP TERMINAL COMPUTER
200 LENS MAKER'S PLANT
201 PLANT SERVER
202 LENS DESIGNING SYSTEM
203 LENS SURFACE EDGING SYSTEM
204 BEVEL-EDGING SYSTEM
210 BEVEL-EDGING SYSTEM SERVER
211 HOLDER BLOCK PART TERMINAL COMPUTER
212 HOLDER BLOCK PART
213 LENS EDGING PART TERMINAL COMPUTER
214 LENS EDGING PART
215 CIRCUMFERENCE MEASURING PART TERMINAL COMPUTER
216 CIRCUMFERENCE MEASURING PART
217 BAR CODE READER
218 STOCKER
219 LENS CARRYING PART
220 ERROR STATION
221 CARRIER TRAY
222 SPECTACLE LENS
223 BEVEL-EDGED SPECTACLE LENS
300 PUBLIC COMMUNICATION LINE
1 FINISHED CIRCUMFERENCE DATA
2 CIRCUMFERENCE DIFFERENCE DATA
3 CIRCUMFERENCE DATA MEMORY PART
4 CIRCUMFERENCE MONITORING MEANS
5 CIRCUMFERENCE CORRECTION VALUE PREPARING MEANS
6 CORRECTION VALUE RENEWING MEANS
7 HISTORY LOG FILE
8 CIRCUMFERENCE CORRECTION VALUE
9 CORRECTION VALUE MEMORY PART
21 DISPLAY MONITOR
22 OPERATOR

The invention claimed is:

1. A method of supplying a spectacle lens by bevel-edging an uncut spectacle lens based on lens edge shape data of a specified spectacle frame, the method comprising:

a lens edging step of bevel-edging the spectacle lens based on the lens edge shape data of the spectacle frame, a predetermined edging condition selected from a plurality of edging conditions, and a circumference correction value that is stored for every edging condition and that is used for obtaining a lens edge circumference of the spectacle frame as a circumference of the spectacle lens, every time bevel-edging order of the spectacle lens occurs;

a lens circumference measuring step of measuring the circumference of the spectacle lens which is bevel-edged in the lens edging step;

a circumferential difference calculating step of obtaining a circumferential difference between the lens circumference which is obtained in the lens circumference measuring step and the lens edge circumference of the spectacle frame; and a correcting step of correcting the circumference correction value so as to keep the circumferential difference within a prescribed range.

2. The method of supplying the spectacle lens according to claim 1, wherein the lens edge shape data includes any one of the information of:

three-dimensional lens edge shape information;

two-dimensional lens edge shape information;

a theoretical circumference, which is the circumference obtained by tracing a bevel groove of the lens edge of the spectacle frame or a template or a dummy lens of a rimless frame;

left eye/right eye information indicating whether or not the lens edge shape data traced by a lens edge shape measuring device is for the left eye or the right eye; and frame/pattern information indicating whether or not the traced lens edge shape data is frame data obtained by tracing the bevel groove of the lens edge of the spectacle frame or pattern data obtained by tracing the template or the dummy lens of the rimless frame.

3. The method of supplying the spectacle lens according to claim 1, wherein the bevel-edging of the spectacle lens is performed by a cutting process and the edging condition is obtained by combining each of:

data showing the kind of a material of the spectacle lens;

edging mode data showing whether or not a circumference shape is obtained by bevel-edging, flat-edging, or mirror-finishing, by an edging mode; and cutting pressure data showing a magnitude of a cutting pressure when the cutting process is executed.

4. The method of supplying the spectacle lens according to claim 1, wherein:

in the lens edging step, the spectacle lens is bevel-edged by using the circumference correction value stored in a correction value memory part for every edging condition;

in the circumferential difference calculating step, the data of the circumferential difference thus calculated is added and stored in a circumferential difference data memory part every time for each bevel-edging; and in the correcting step, the following steps are executed including a monitoring step of continuously monitoring whether or not the circumferential difference data stored in the circumference difference data memory part is kept within the prescribed range, a circumference correction value re-making step of re-making the circumference correction value so that the circumferential difference data is returned in the prescribed range when it is beyond the prescribed range, and a correction value updating step of updating the circumference correction value of the correction value memory part to a re-made circumference correction value when the circumference correction value is re-made in the circumference correction value re-making step.

5. The method of supplying the spectacle lens according to claim 4, wherein:

in the lens edging step, the bevel edging of the spectacle lens is executed by using multiple lens edging parts that each independently can execute the bevel-edging of the spectacle lens; and in the monitoring step, the circumferential difference data based on the edging result is independently monitored for each lens edging part.

6. The method of supplying the spectacle lens according to claim 4, wherein the circumferential difference data based on the edging result is independently monitored for each lens edging condition in the monitoring step.

7. The method of supplying the spectacle lens according to claim 1, wherein the bevel-edging is performed by a cutting process and by using a diamond wheel as a cutting tool for the cutting process, in which a grind stone powder is sintered or electrodeposited in the peripheral area of a cylindrical body.

* * * * *